US006726416B2

(12) United States Patent
Shoup

(10) Patent No.: US 6,726,416 B2
(45) Date of Patent: Apr. 27, 2004

(54) DIE STORAGE CONTAINER

(75) Inventor: Max M. Shoup, Flint, MI (US)

(73) Assignee: Griswold Machine & Engineering, Inc., Union City, MI (US)

( * ) Notice: Subject to any disclaimer, the term of this patent is extended or adjusted under 35 U.S.C. 154(b) by 26 days.

(21) Appl. No.: 10/300,155

(22) Filed: Nov. 20, 2002

(65) Prior Publication Data

US 2003/0219323 A1 Nov. 27, 2003

Related U.S. Application Data

(60) Provisional application No. 60/382,747, filed on May 23, 2002.

(51) Int. Cl.[7] ..... B65D 19/00

(52) U.S. Cl. ..... 410/46; 410/31

(58) Field of Search ..... 410/46, 31, 35, 410/44; 108/53.1, 53.5, 55.1, 57.17; 220/1.5

(56) References Cited

U.S. PATENT DOCUMENTS

| | | | | |
|---|---|---|---|---|
| 2,170,913 | A | 8/1939 | Rowe | |
| 2,808,788 | A | * 10/1957 | Stough | 410/89 |
| 3,355,029 | A | * 11/1967 | Eurey | 410/46 |
| 3,586,204 | A | 6/1971 | Roper | |
| 3,620,388 | A | * 11/1971 | Mansson | |
| 4,660,724 | A | 4/1987 | Gaynes | |
| 4,711,016 | A | 12/1987 | Genschow et al. | |
| 4,745,952 | A | * 5/1988 | French | |
| 4,803,772 | A | 2/1989 | Leverenz | |
| 4,819,554 | A | 4/1989 | Fleischer et al. | |
| 4,842,458 | A | 6/1989 | Carpenter | 410/3 |
| 4,877,361 | A | 10/1989 | DeRosa et al. | 410/112 |
| 4,986,705 | A | * 1/1991 | Durkin | 410/57 |
| 5,366,431 | A | 11/1994 | Smith et al. | |
| 5,800,106 | A | 9/1998 | Miller | 410/117 |
| 5,961,263 | A | 10/1999 | Nunez | 410/103 |
| 6,050,761 | A | * 4/2000 | Keip et al. | 410/35 |
| 6,056,122 | A | 5/2000 | Takeuchi | |
| 6,113,328 | A | 9/2000 | Claucherty | 410/106 |
| 6,146,069 | A | 11/2000 | Elwell et al. | 410/106 |
| 6,273,654 | B1 | 8/2001 | Whitaker | 410/116 |
| 6,290,440 | B1 | 9/2001 | DiViccaro | 410/103 |
| 6,524,040 | B1 | * 2/2003 | Heil | 410/67 |
| 2002/0159855 | A1 | * 10/2002 | Ketchmark | 410/31 |

* cited by examiner

*Primary Examiner*—Stephen T. Gordon
(74) *Attorney, Agent, or Firm*—Howard & Howard

(57) ABSTRACT

A transportable container (10) for storing part (30) comprises a body that includes a bottom wall (14), a back wall (16), and end walls (18), (20) extending outwardly from the bottom wall (14) and interconnected by a top wall (22) defining an open front (24), and a door (26) to cover the open front (24). A plurality of support rails (28) disposed on the bottom wall (14) for supporting the part (30), include a plurality of bores (32) therein and a plurality of drop-in pins (34) removably disposed in the bores (32) for engaging the part (30) disposed therein and for preventing movement of the part (30) stored in the container (10). The door (26) of the container (10) includes at least one handle (88) to rotate the door (26) about guide fingers (84) and push the door (26) over the top wall (22), and at least one lock (90) to secure the door (26) in a closed position.

24 Claims, 8 Drawing Sheets

DIE STORAGE CONTAINER

This application claims priority from the copending provisional application Serial No. 60/382,747, filed May 23, 2002.

BACKGROUND OF THE INVENTION

Field of the Invention

Description of the Prior Art

Generally, metallic molds for molding different products, dies for stamping a sheet metal or variety of precious pieces of machinery are very expensive. When these molds, dies, and other pieces of expensive machinery needed to be transported from one location to another, they are placed within a wooden box and packed with corrugated paperboards, or the like, to provide a cushion and to prevent the molds from being damaged during transportation.

Numerous transportable storage containers are known in the prior art and widely used today in the industry. U.S. Pat. Nos. 6,056,122 to Takeuchi and 4,660,724 to Gaynes disclose a variety of transportable storage containers.

The '122 Patent to Takeuchi discloses a transportable storage container, which includes a box-like cover member having an opened bottom portion and a base member, which is provided under the box-like cover member. The base member is used to mount expensive metallic molds, dies, and other pieces of machinery, and is buckled to detachable box-like cover, whereby the metallic mold, dies, or the like, held in the container, are protected from rusting due to invasion of water.

The '724 Patent to Gaynes discloses a container for storing solids having elongate rectangular shape with a length and width equal to its height. The container includes upstanding lip on a top wall and a depending lip on a bottom wall rest within one another to prevent lateral shifting of stacked containers. The bottom depending lip spaces the bottom wall of the container from a floor to create a space for receiving the forks of lift trucks thereunder. The upstanding lip creates a space between stacked containers for receiving the forks of lift trucks therebetween. Openings in the top wall and both end walls provide access to the internal storage chamber, and the openings are protected from damage by overhanging top and bottom walls and the upstanding lip. The upstanding lip includes perforations for lifting the container with such as rope or chains from above.

Although the prior art patents provide a transportable container capable of transporting a heavy pieces such as metallic dies, or the like, from one molding plant to another, one of the opportunities of continuous development and research is the area of a more advanced design of a storage container for dies, molds, and other pieces of expensive machinery that are capable of transporting and storing of dies, molds and pieces of precious machinery being precisely finished, and that may prevent them from sliding and rubbing against the walls of the container during transportation.

BRIEF SUMMARY OF INVENTION

A transportable container for storing part includes a body having a bottom wall, a top wall, back and end walls defining an open front. The container includes a door for covering the open front, a plurality of support rails disposed on the bottom wall of the body designed for supporting the part above the bottom wall. The container is characterized by a plurality of bores in the rails and a plurality of drop-in pins removably disposed in the bores for engaging part disposed therein for preventing movement of part stored in the container.

Accordingly, the container of the present invention is efficient and may protect the dies, molds, and pieces of precious machinery from sliding and rubbing against the walls of the container.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
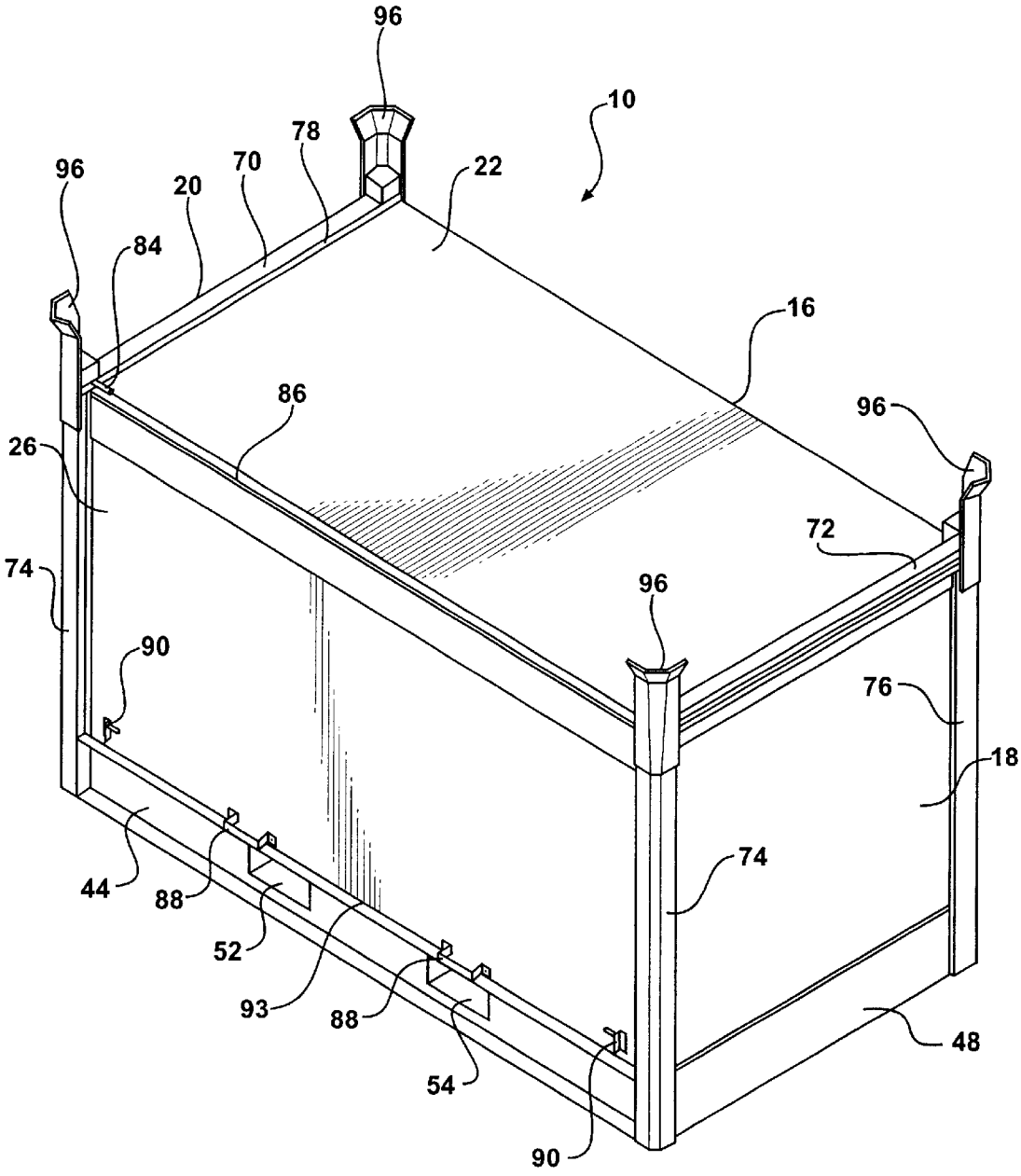
FIG. 1 is a perspective view of a die storage container.
Figure 2:
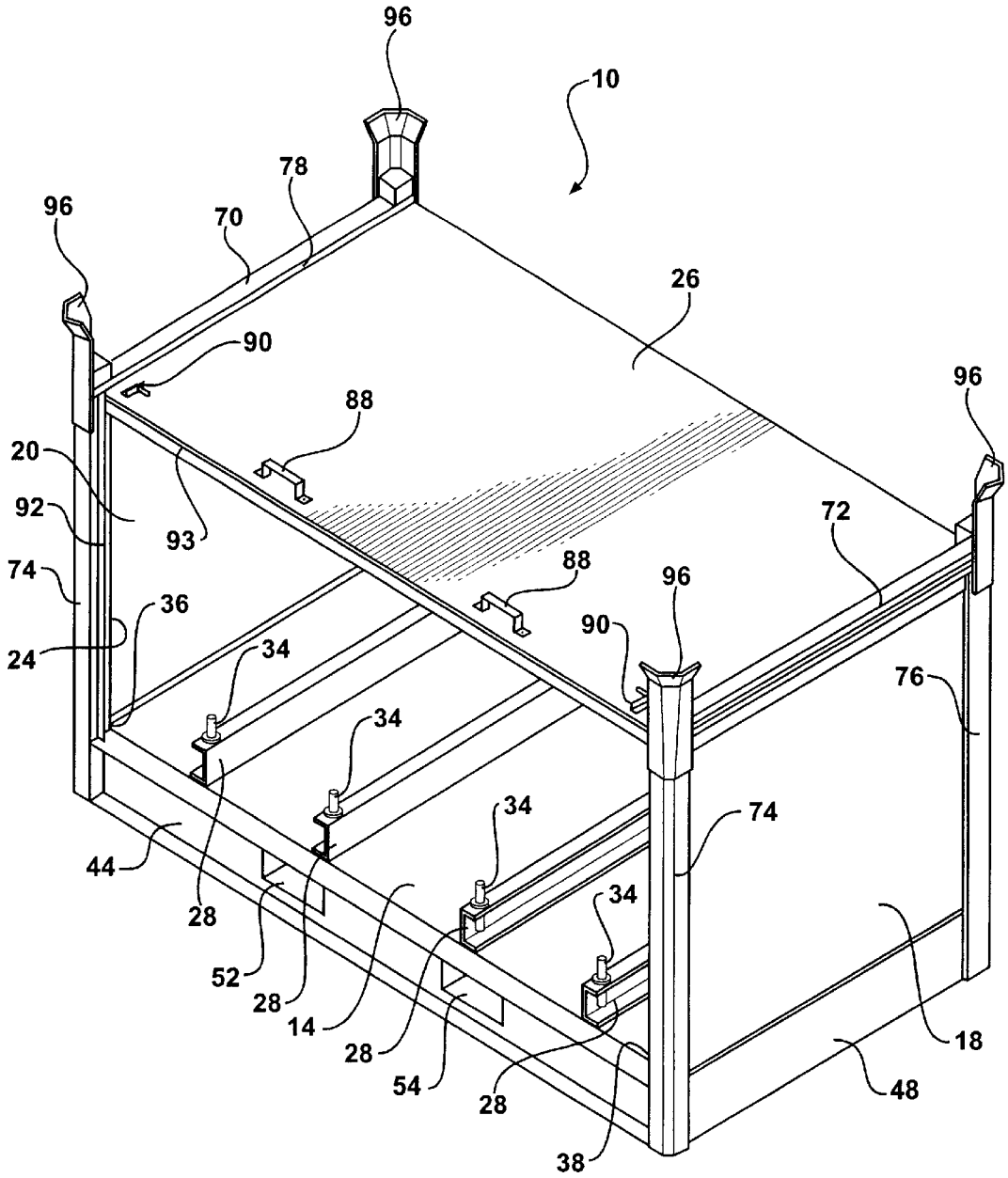
FIG. 2 is a perspective view of the die storage container with open front that shows the drop-in pins disposed in bores of rails for engaging part disposed in the container for preventing movement of the part therewithin.
Figure 3:
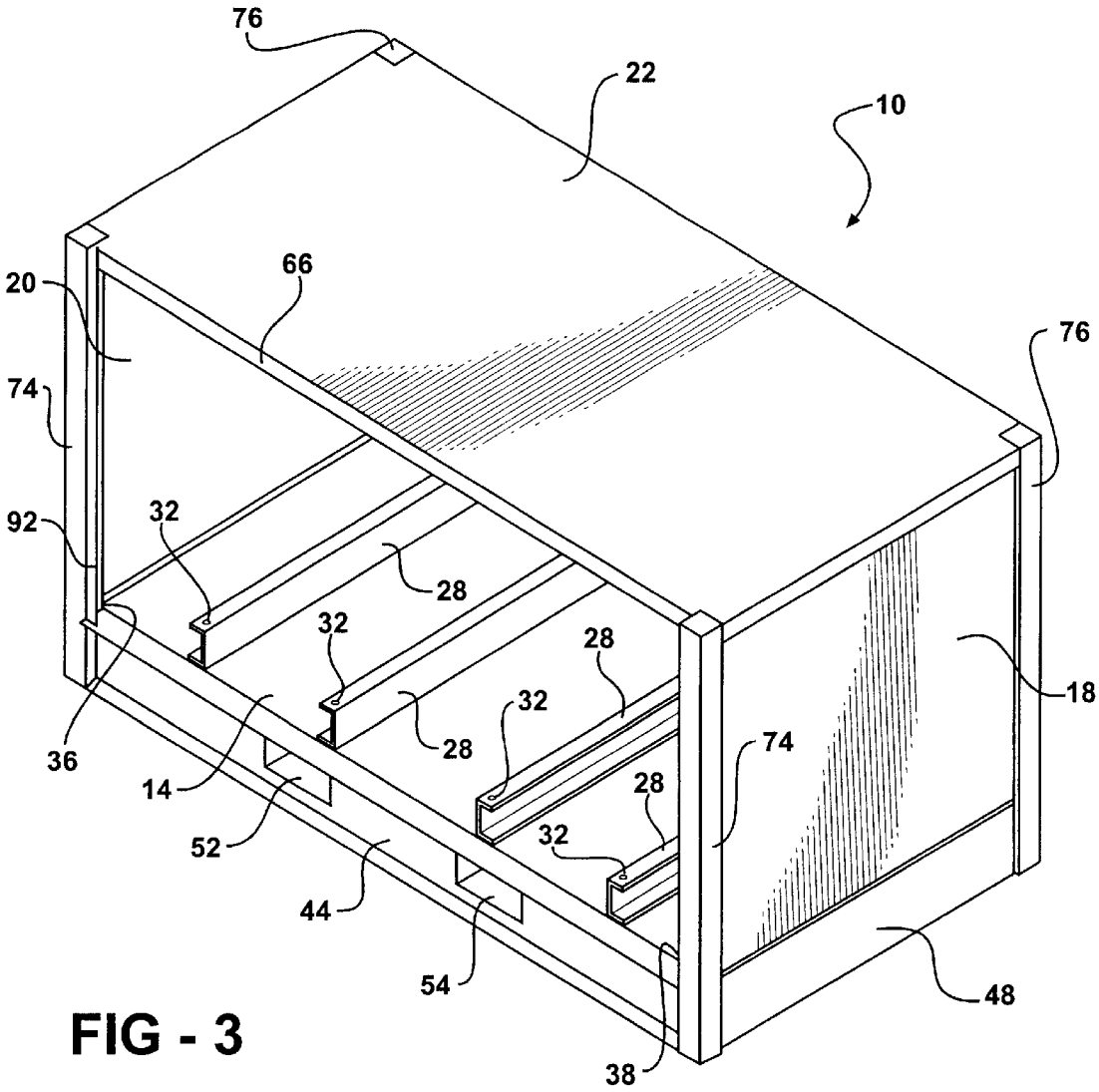
FIG. 3 is a perspective view of the die storage container with open front that shows bores in rails designed to receive drop-in pins.
Figure 4:
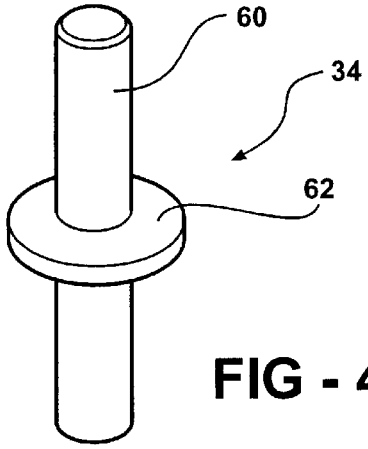
FIG. 4 is a perspective view of a drop-in pin.
Figure 5:
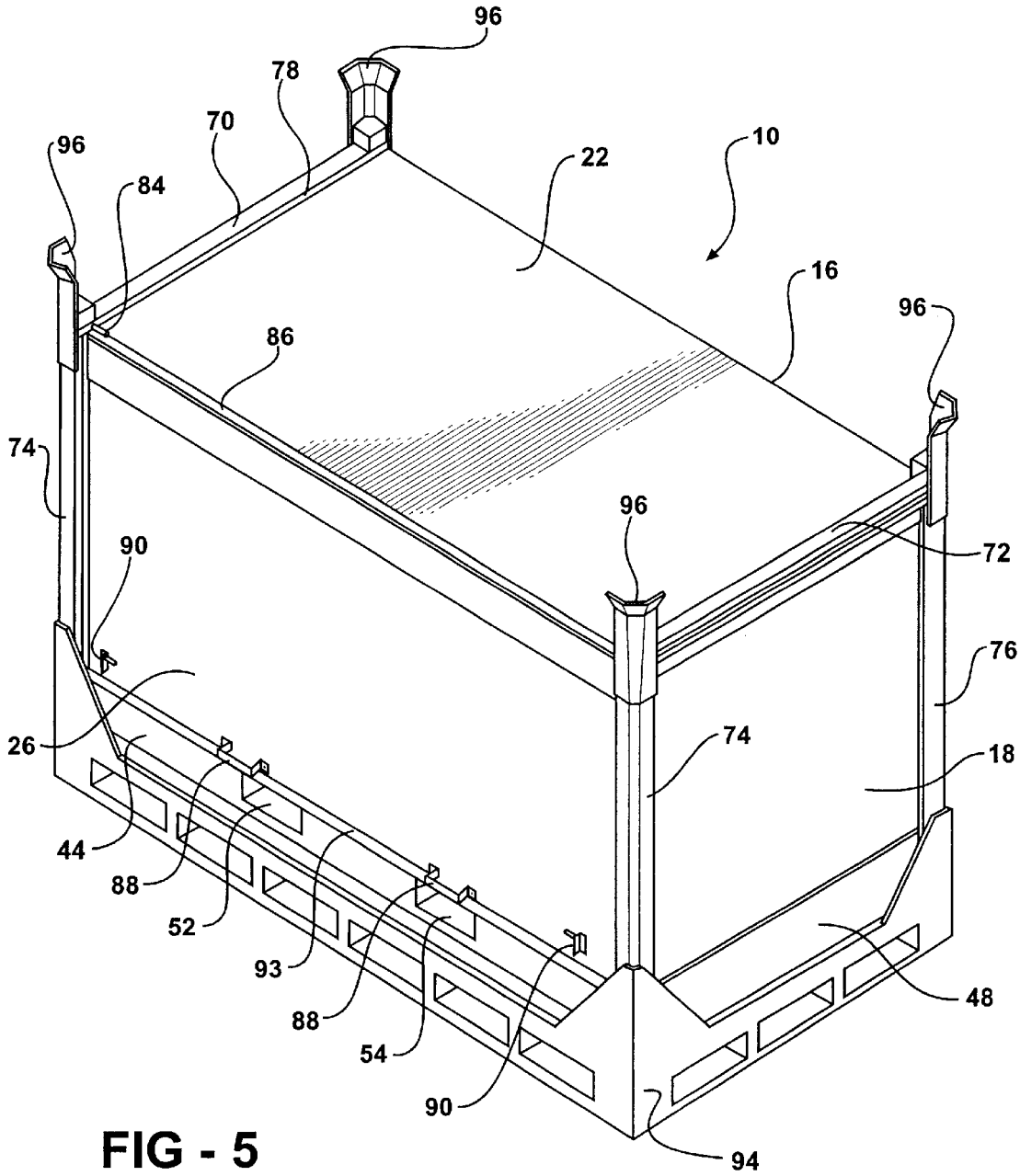
FIG. 5 is a perspective view of the die storage container placed on a platform.
Figure 6:
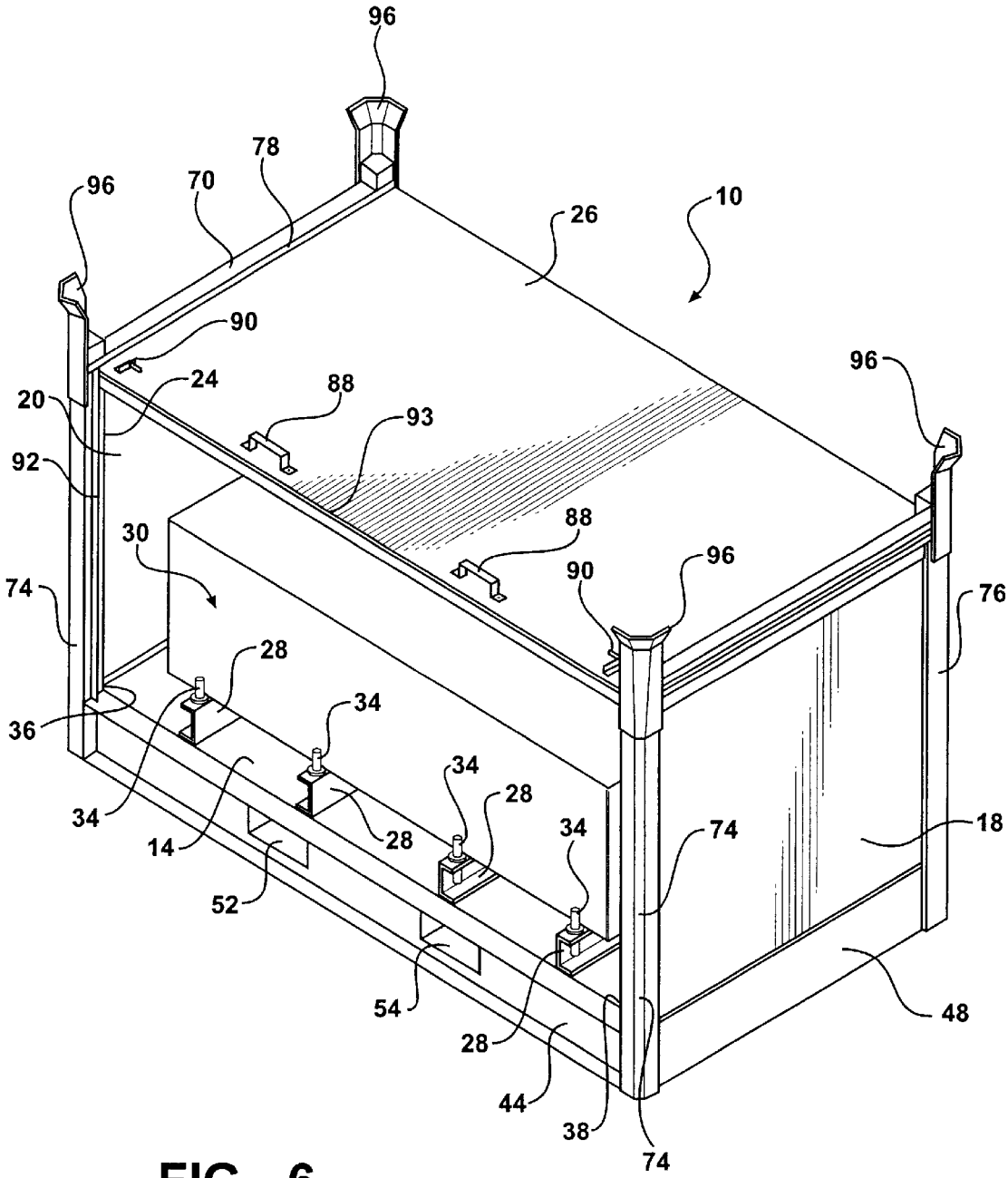
FIG. 6 is a perspective view of the die storage container with the door being opened and positioned on top of the container and a part disposed in the container.
Figure 7:
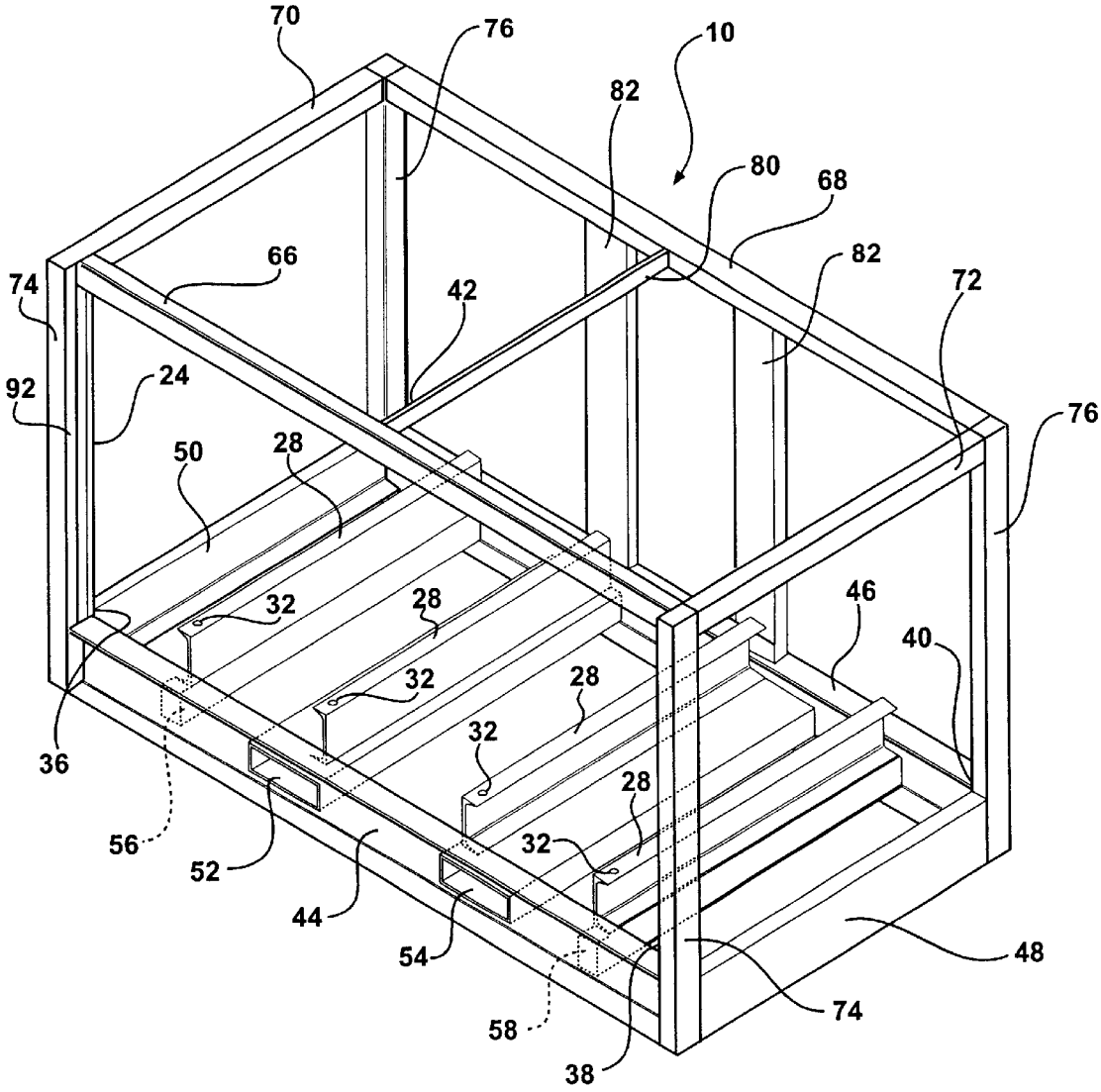
FIG. 7 is a perspective view of the frame of the die storage container.

Referring to the FIGS. 1 through 9, wherein like numerals indicate like or corresponding part throughout the several views, a transportable storage container for storing dies, molds, and variety of other precious pieces of machinery, is generally shown at 10.

The transportable container 10 comprises a body that includes a bottom wall 14, a back wall 16, and end walls 18, 20 extending outwardly from the bottom wall 14 and interconnected by a top wall 22 to define an open front 24. The container 10 includes a door, generally indicated at 26, to cover the open front 24. The container 10 further includes a plurality of support rails 28 disposed on the bottom wall 14 for supporting the dies, molds, and other pieces of precious heavy equipment, referred further below as the part and generally indicated at 30, above the bottom wall 14. The container 10 is characterized by a plurality of bores 32 in the rails 28 and a plurality of drop-in pins 34 removably disposed in the bores 32 for engaging the part 30 disposed therein for preventing movement of the part 30 when stored in the container 10.

The bottom wall 14 of the container 10 includes four corners 36, 38, 40, 42, and comprises front 44, rear 46, and end 48, 50 beams interconnected at the corners 36, 38, 40, 42 wherein the bottom wall 14 is supported on the front 44, rear 46 and end 48, 50 beams, respectively. Referring specifically to the structure of the beams, the front 44 and rear 46 beams are I-beams in cross-section whereas the end beams 48, 50 comprise channels with a C-shaped cross-section. The bottom wall 14 includes a pair of fork-lift sleeves 52, 54 spaced in parallel relationship to one another and extending between the front 44 and rear 46 beams for receiving the tongs of the fork of a fork-lift truck (not shown) to move the container 10 from one location to another.

The bottom wall 14 of the container 10 further includes bottom reinforcing beams 56, 58 that extend between the front 44 and rear 46 beams and spaced in parallel relationship to one another and adjacent the fork-lift sleeves 52, 54. The reinforcing beams 56, 58 each comprise a hollow tube structure and provide additional support for the bottom wall 14 along with the fork-lift sleeves 52, 54.

The rails 28 are positioned above the reinforcing beams 56, 58 and the fork-lift sleeves 52, 54, respectively. The rails 28 are spaced in parallel relationship to one another and extending between the open front 24 and the back 16 wall. The rails 28 have a C-shaped cross-section and extend upwardly from the bottom wall 14. Each of the rails 28 comprises the bore 32 at one of the rail's 28 extremities near the front 24 of the container 10. The bore 32 is spaced above the bottom wall 14 and is designed to receive the drop-in pin, generally indicated at 34.

Each drop-in pin 34 comprises a rod 60 and a flange 62 extending radially from the rod 60 to engage the respective rail 28 when the drop-in pin 34 is disposed in one of the bores 32 to extend upwardly from the flange 62 for engaging the part 30. The drop-in pins 34 are removably disposed in the bores 32 to be disengaged therefrom to allow the part 30 to be placed on the rails 28. The rails 28 may include plurality of the bores 32 spaced from one another along the rail 28 to engage different sizes of the part 30 therein. When the part 30 is positioned on the rails 28, the drop-in pins 34 are disposed into the bores 32, respectively, to secure the part 30 within the container 10 and to prevent the part 30 from sliding forward.

The container 10 includes a pair of front 74 and rear 76 vertical posts, respectively, at each of the corners 36, 38, 40, 42 of the bottom wall 14 extending upwardly from the intersection of the front 44, rear 46, and end 48, 50 beams to respective tops. The front 74 and rear 76 vertical posts are interconnected with front 66, rear 68 and end 70, 72 top beams at their respective tops to support the top wall 22 positioned on the top beams 66, 68, 70, 72. A door track 78 is disposed at each end of the top wall 22 and extends between the tops of the front 74 and rear 76 posts.

The container 10 comprises at least one supplemental top beam 80 that extends between the front 66 and rear 68 top beams and is spaced in parallel relationship to and between the end walls 18, 20. The supplemental top beam 80 is designed to support the top wall 22 of the container 10 and comprises a hollow structure.

The container 10 includes at least one supplemental vertical post 82 extending vertically between the rear top 68 and bottom 46 beams and engaging the back wall 16. The vertical post 82 also comprises a hollow tube structure.

The door 26 of the container 10 includes a guide finger 84 at each of extremities of a top edge 86 for engaging the tracks 78 when the door 26 is moved between a closed positioned covering the open front 24 of the container 10 and open position wherein the guide fingers 84 move along the tracks 78 and the door 26 is moved over the top wall 22. The door 26 also includes at least one handle 88 to rotate the door 26 about the guide fingers 84 and to push the door 26 backward over the top wall 22 as the guide fingers 84 are moved rearwardly in the tracks 78.

In addition to the handle 88, the door 26 includes at least one lock 90 positioned at a corner and along a bottom edge 93 of the door 26. The lock 90 is designed to secure the door 26 in the closed position covering the open front 24 of the container 10. To prevent the door 26 from rotating into the container 10, each of the front posts 74 comprise a door jam 92 extending vertically adjacent each front post 74 at the open front 24.

When the container 10 is moved from one location to another, the container is placed on a platform 94. To provide an extra space at the storage location, the container 10 may include a container support 96 removably attached to the tops of the front 74 and rear 76 posts for supporting another container placed above the container 10. Several containers may be stacked on top of one another wherein a bottom of each post 74, 76 will co-act with the perspective tops of the post 74, 76 of the container positioned below.

Figure 8:
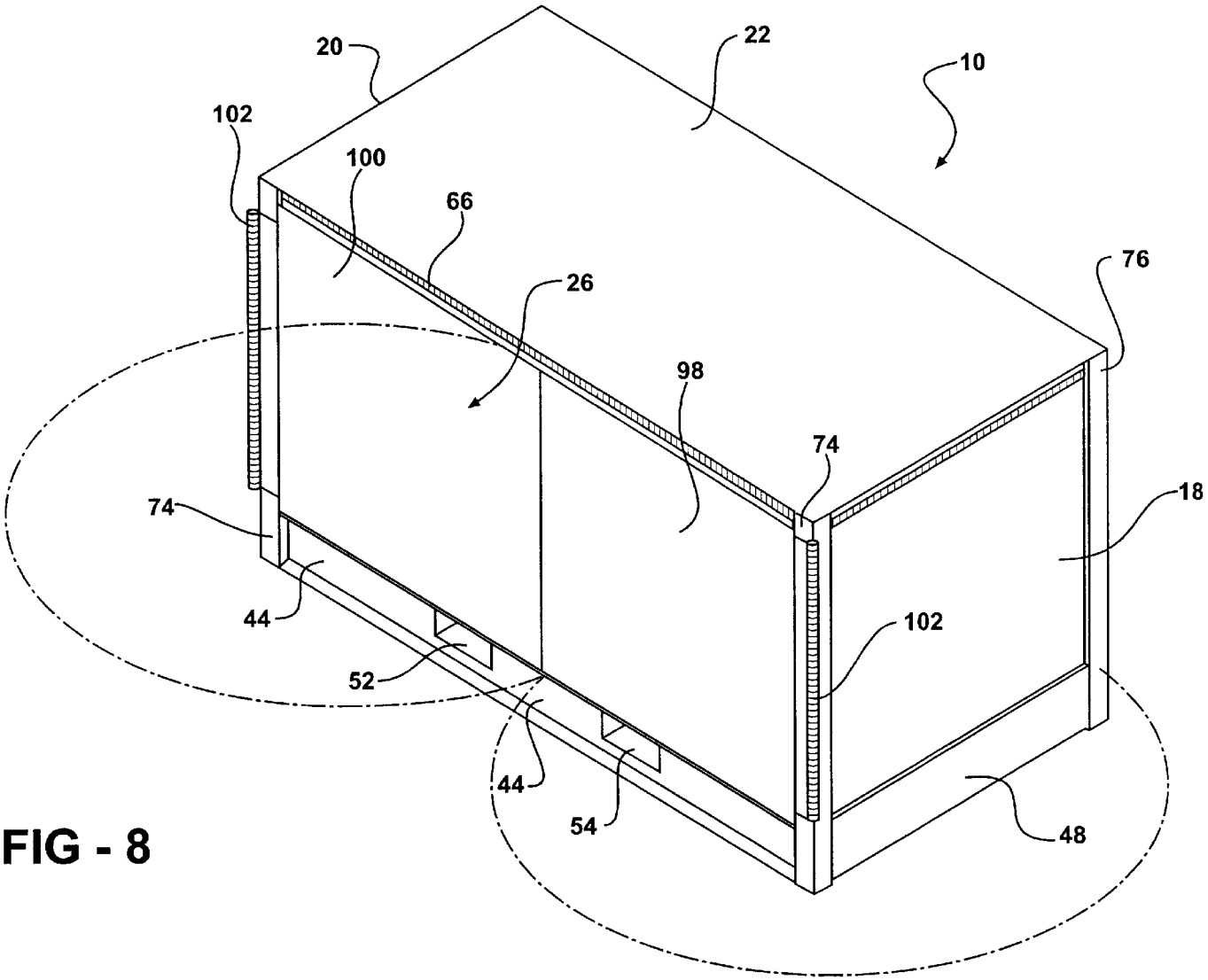
FIG. 8 is a perspective view of an alternative embodiment of the die storage container with revolving doors being closed.
Figure 9:
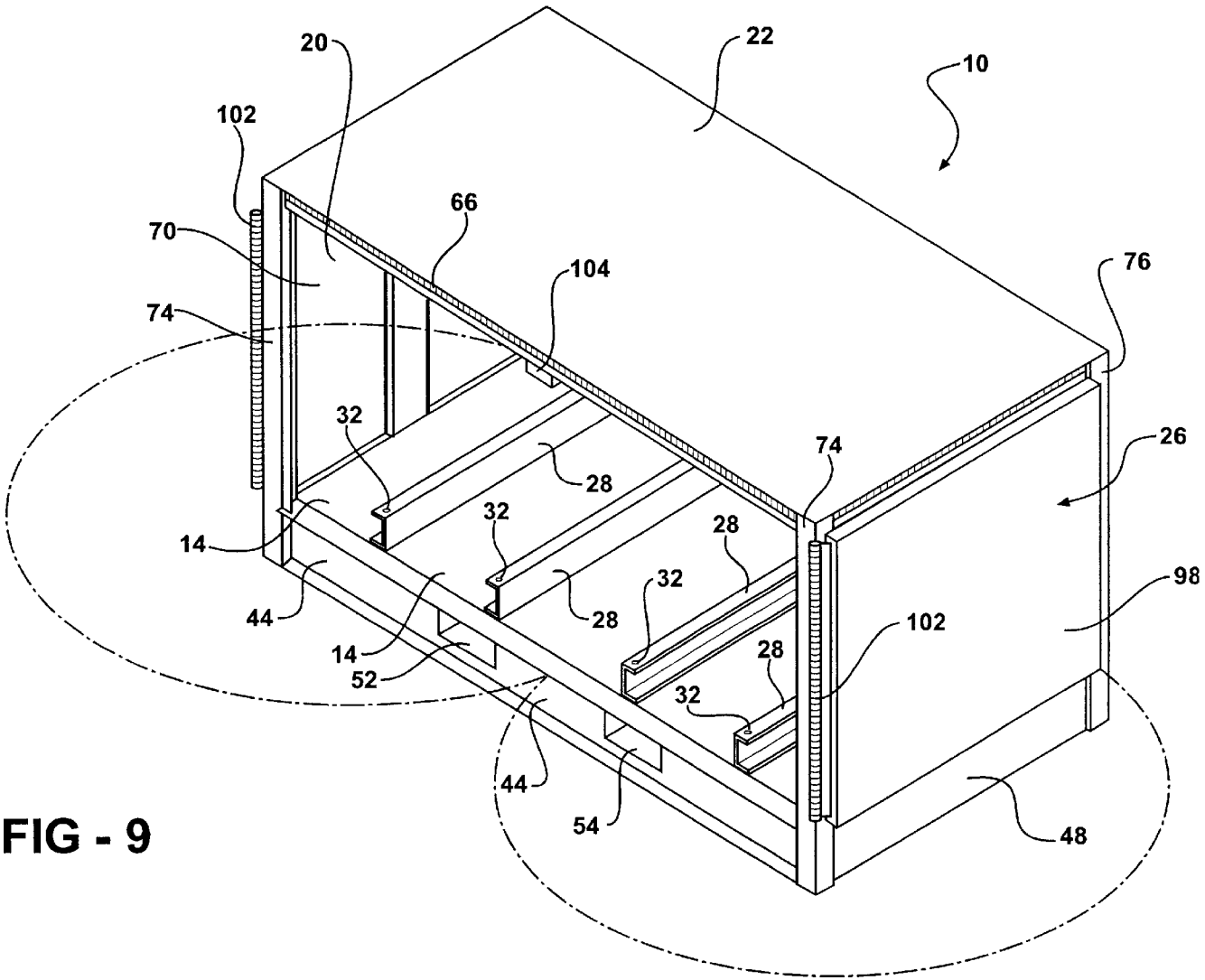
FIG. 9 is a perspective view of the alternative embodiment of the die storage container with the cabinet doors being opened and positioned adjacent end walls of the die storage container.

In the alternative embodiment of FIGS. 8 and 9, the door 26 comprises first 98 and second 100 cabinet type doors wherein each of said doors 98, 100 is mounted by a hinge 102 extending vertically adjacent each front post 74 at the open front 24. Preferably, the hinge 102 allows each of the cabinet doors 98, 100 to open about the hinge 102 to a position adjacent or touching the side walls 18, 20 of the container 10, respectively. The container 10 further includes at least one stop 104 that extends horizontally adjacent the front top 66 and front 44 beams at the open front 24 to prevent the cabinet doors 98 and 100 from rotating into the container 10.

The container supports 96, removably attached to the tops of the posts 74, 76 of the container positioned below, may partially embrace the bottoms of each post 74, 76, respectively, of the container stacked on top, and will prevent the container from sliding back and forth and falling on the ground, damaging the part, located inside the container.

The container 10 facilitates a method of storing contaminated part comprising the steps of placing the part 30 having contaminates thereon in the container 10, hermetically sealing the container 10 with the part 30 therein, and storing the container 10 in an atmospheric environment, i.e., outside where it rains or snows. As it can be understood by those skilled in the art, the part 30 stored in the container 10 usually have coatings applied, e.g., COUZMELEAN, which would contaminate the ground when washed off the part 30 by rain, melted snow, dew, etc. To prevent contamination, the container 10 is welded closed and covered with coating for providing an air tight seal. Variety of coatings that will resist water penetration into the container may be used. One of the coatings, called polyurea coating, that is a high elongation elastomer that has good penetrating characteristics that enhance adhesion to porous surfaces and is used to seal joints in low temperature applications such as cold storage.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A transportable container (10) for storing a part (30) comprising:

a body having bottom (14), top (22), back (16) and end (18), (20) walls defining an open front (24), a door (26) for covering said open front (24), a plurality of support rails (28) disposed on said bottom wall (14) for supporting the part (30) above said bottom wall (14), said container (10) characterized by a plurality of bores (32) in said rails (28) and a plurality of drop-in pins (34) removably disposed in said bores (32) for engaging the part (30) disposed therein for preventing movement of the part (30) when stored in said container (10).

2. A container (10) as set forth in claim 1 wherein each said drop-in pin (34) comprises a rod (60) and a flange (62) extending radially from said rod (60) to engage a respective said rail (28) as said pin (34) is disposed in one of said bores (32) to extend upwardly from said flange (62) for engaging the part (30).

3. A container (10) as set forth in claim 2 wherein said rails (28) extend upwardly from said bottom wall (14) whereby said bores (32) are spaced above said bottom wall (14).

4. A container (10) as set forth in claim 3 wherein said rails (28) have a C-shaped cross-section and extend between said open front (24) and back wall (16).

5. A container (10) as set forth in claim 3 wherein said bottom wall (14) has four corners (36), (38), (40), (42) and including front (44), rear (46) and end (48), (50) beams interconnected at said corners (36), (38), (40), (42), said bottom wall (14) being supported on said beams (44), (46), (48), (50).

6. A container (10) as set forth in claim 5 including a pair of fork-lift sleeves (52), (54) spaced in parallel relationship to one another and extending between said front (44) and rear (46) beams for receiving the tongs of a fork-lift truck.

7. A container (10) as set forth in claim 6 wherein said front (44) and rear (46) beams are I-beams in cross-section.

8. A container (10) as set forth in claim 7 wherein said end beams (48), (50) are channels with C-shaped cross-sections.

9. A container (10) as set forth in claim 6 including a pair of front vertical posts (74) and a pair of rear vertical posts (76) with one of said posts at each of said corners (36), (38), (40), (42) extending upwardly from the intersections of said front (44), rear (46) and end (48), (50) beams to respective tops.

10. A container (10) as set forth in claim 9 including front (66), rear (68) and end (70), (72) top beams being interconnected one with the other at respective tops of said top (66), (68), (70), (72) beams, said top wall (22) being supported on said top (66), (68), (70), (72) beams.

11. A container (10) as set forth in claim 10 including at least one supplemental top beam (80) extending between said front (66) and rear (68) top beams and spaced between said end walls (18), (20) for supporting said top wall (22).

12. A container (10) as set forth in claim 10 including at least one supplemental vertical post (82) extending vertically between said rear top beam (68) and of said bottom wall beam (46) and engaging said back wall (16).

13. A container (10) as set forth in claim 10 wherein said top beams (66), (68), (70), (72) are hollow.

14. A container (10) as set forth in claim 11 including bottom reinforcing beams (56), (58) extending between said front (44) and rear (46) beams under said bottom wall (14) for providing additional support for said bottom wall (14).

15. A container (10) as set forth in claim 14 wherein said reinforcing beams (56), (58) are hollow.

16. A container (10) as set forth in claim 10 including a door track (78) disposed at each end of said top wall (22) and extending between the tops of said front (74) and rear (76) posts, said door (26) including guide fingers (84) for engaging said tracks (78) for moving said door (26) between a closed position covering said open front (24) and an open position as said guide fingers (84) move along said tracks (78) and said door (26) moves over said top wall (22).

17. A container (10) as set forth in claim 16 wherein said door (26) includes a handle (88) to rotate said door (26) about said guide fingers (84) and to push said door (26) over said top wall (22) as said guide fingers (84) move rearwardly in said tracks (78).

18. A container (10) as set forth in claim 16 wherein said door (26) further includes at least one lock (90) to secure said door (26) wherein said lock (90) is positioned at a corner and along a bottom edge (93) of said door (26).

19. A container (10) as set forth in claim 16 including a door jam (92) extending vertically adjacent each front post (74) at said open front (24) for preventing said door (26) from rotating into said container (10).

20. A container (10) as set forth in claim 10 wherein said door (26) comprises first (98) and second (100) cabinet doors hinged (102) along said front vertical posts (74).

21. A container (10) as set forth in claim 20 including at least one door stop (104) disposed at the open front (24) for preventing said cabinet doors (98), (100) from rotating into said container (10).

22. A container (10) as set forth in claim 10 including a container support (96) removably attached to the tops of said posts (74), (76) for supporting another container placed above said container (10).

23. A container (10) as set forth in claim 1 wherein said body is welded closed for providing an airtight seal.

24. A container (10) as set forth in claim 1 wherein said body is coated with polyurea coating for providing an airtight seal.

* * * * *